United States Patent [19]

Crawford

[11] 4,023,289

[45] May 17, 1977

[54] METALLIC POWDER FLUID SUSPENSION

[76] Inventor: William G. Crawford, 1115 N. Carrizo, No. 1, Midland, Tex. 79701

[22] Filed: Feb. 2, 1976

[21] Appl. No.: 654,283

Related U.S. Application Data

[63] Continuation of Ser. No. 489,377, July 17, 1974, abandoned.

[52] U.S. Cl. ..... 40/106.21
[51] Int. Cl.[2] ..... G09F 19/00
[58] Field of Search ..... 40/106.21, 106.22, 106.23; 35/19 A; 252/131, 123, 90

[56] References Cited

UNITED STATES PATENTS

| | | | |
|---|---|---|---|
| 1,458,050 | 6/1923 | Chester | 40/106.21 |
| 3,432,941 | 3/1969 | Minchom | 35/19 A |
| 3,522,186 | 6/1970 | Cambre | 252/112 |
| 3,531,635 | 9/1970 | Hancock | 40/106.22 X |
| 3,593,444 | 7/1971 | Akrongold et al. | 40/106.21 |

FOREIGN PATENTS OR APPLICATIONS

| | | | |
|---|---|---|---|
| 1,232,311 | 5/1971 | United Kingdom | 40/106.21 |

*Primary Examiner*—John F. Pitrelli
*Attorney, Agent, or Firm*—Warren H. Kintzinger

[57] ABSTRACT

A liquid vehicle, holding metallic particles in sustained suspension and usable for viewable aesthetic display purposes, the vehicle being a solution of water, soap, and optional coloring agent.

1 Claim, 1 Drawing Figure

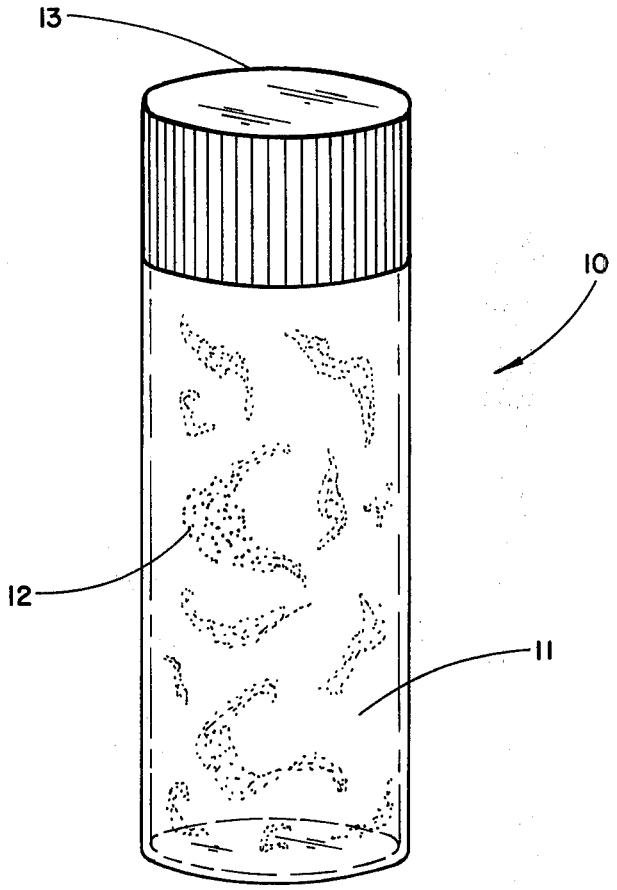
13
10
12
11

METALLIC POWDER FLUID SUSPENSION

This is a continuation of application Ser. No. 489,377, filed July 17, 1974, now abandoned.

This invention relates in general to aesthetic display devices, and in particular, to an improved displayable substance comprised of powdered metallic particles held in sustained suspension in a liquid vehicle.

Novelty viewing devices of the type employing particle suspension in a liquid vehicle are known in the art. For example, devices using suspension of lightweight, flake-like particles in water are widely used in "snow storm" novelties wherein normally (quiescently) settled or separated flakes disperse through the water when the device is agitated, as by shaking, and rapidly swirl with a settling motion to simulate falling snow against and/or about a figure or scene carried within the vehicle container.

Still other visual display devices employ crystalline powder in solutions containing, among other constituents, water and oil, and the powder is caused to remain suspended in the solution primarily by some sort of continuous stirring or agitating means which imparts motion to the liquid vehicle in which the particles are carried.

Known display devices of the above-described general type have not provided a vehicle within which flakes or powders of metals may be successfully caused to be dispersed in separated suspension in a liquid vehicle because of the tendency of metallic particles to "bunch-up" due to mutual adherence and resist individual particle suspension throughout the liquid vehicle.

It is therefore a principal object of the present invention to provide an improved liquid vehicle for carrying particles in separated suspension.

Another object is to provide a liquid vehicle for holding, in separated suspension, powders of a metallic type, the specific gravity of which otherwise precludes individual particle suspension, as would be desirable for use in an aesthetic display device.

A further object is to provide a liquid vehicle in which individual particles of metallic powders may be rapidly suspended by application of minimal agitation.

A still further object of this invention is to provide an inexpensive vehicle comprised of common ingredients for use in holding metallic powders in particle-separated suspension.

Features of this invention useful in accomplishing the above objects include, in combination, a substantially transparent container within which is contained a liquid vehicle comprised basically of water and soap, and in which vehicle there is suspended a quantity of metallic powder. Coloring may be optionally added to realize a variety of decorative effects.

A specific embodiment representing what is presently regarded as the best mode of carrying out the invention is illustrated in the accompanying drawing, in which the single FIGURE shows a transparent container carrying a viewable liquid vehicle of a type to be described, in in which metallic powder is to be suspended.

Referring to the drawing:

A transparent container, i.e., a bottle 10 holds a liquid vehicle 11 carrying a quantity of metallic powder 12. The container member 10 may be of any desired form and may be closed by means of a simple cap means 13.

Powders, flakes, etc., of materials remain suspended in liquids for periods of time, related to the specific gravity and to the mutual attraction properties of the material. Means such as oils have been used, for example, to hold salad dressing spices and other solid ingredients in suspension, and a desirable property of salad dressings is the ability to maintain individual particle suspension for a useful period of time, after being mixed or shaken.

To realize the highly decorative effects of metallic powders held in liquid suspension, the inherently higher specific gravity of metallic substances, together with their inherent tendency to self-adhere when in powdered or flaked form, it is required that a constant source of agitation be used to maintain suspension, or, alternately, that a liquid vehicle be used into which the powder or flakes may be held in separated suspension for a reasonable length of time. My invention realizes the last stated alternative, and may be enhanced by minimum application of the first alternative.

The liquid vehicle 11 in the Figure, in accordance with my invention, is comprised of a mixture, in solution, of water and soap. A metallic powder 12 of desired kind is added to the water and soap solution. The soap is readily soluble in the water and enables every particle of the metallic powder to be separably suspended in the solution by providing advantageous specific gravity and lubricity characteristics to the vehicle.

For desired aesthetic viewing, a coloring agent, such as common food coloring, may be included in the solution.

When the solution is agitated, the metallic particles begin to fold and swirl through the solution, reflecting light back to the viewer at different intensities. Since the metallic particles are readily caused to be dispersed throughout the vehicle in separated suspension, a minimum of agitation produces the desired visual effect.

I have found the following mixture to be effective in accomplishing the named objectives of my invention:

Approximately 95% water;
Approximately 2% food coloring;
Approximately 2% soap; and,
Approximately 1% metallic powder.

It should be realized that the above mixture is by way of preference and not by way of limitation as concerns my invention, since other percentages might be used without departing from essential contributions to the art made by the teachings hereof.

I claim:

1. An aesthetically viewable device comprising a substantially transparent container means, a viewable substance confined within said container means; said substance comprising a solution of greater than ninety percent water and less than five percent soap, consisting of a mixture of water soluble alkali metal group salts of fatty acids, and a quantity of metallic particles held in individual particle suspension within said solution; said metallic particles comprising a powder of metal from a class of metals respective particles of which normally exhibit mutual adherence said substance is comprised of substantially 95 percent water, substantially two percent coloring agent, substantially 2 percent of said soap, and substantially 1 percent of said metallic powder.

* * * * *